US005284072A

United States Patent [19]

Smith

[11] Patent Number: 5,284,072

[45] Date of Patent: Feb. 8, 1994

[54] CLEAT REMOVAL/INSERTION TOOL

[76] Inventor: Rodney Smith, Rte. 5, Box 128E, Staunton, Va. 24401

[21] Appl. No.: 839,309

[22] Filed: Feb. 20, 1992

[51] Int. Cl.[5] ..... B25B 13/46

[52] U.S. Cl. ..... 81/63; 81/439; 81/176.15

[58] Field of Search ..... 81/63, 176.15, 439, 81/438, 60–63.2, 439, 176.1, 176.2, 185, DIG. 11

[56] References Cited

U.S. PATENT DOCUMENTS

| | | | |
|---|---|---|---|
| 1,440,272 | 12/1922 | Bratton | 81/62 |
| 2,300,866 | 11/1942 | Bernstein | 81/90 |
| 2,448,805 | 9/1948 | Ingram | 81/176.15 |
| 2,459,610 | 1/1949 | Zadina | 36/67.5 |
| 2,461,639 | 2/1949 | Grigalunas | 81/90 |
| 3,140,625 | 7/1964 | Pannozzo | 81/176.15 X |
| 3,412,635 | 11/1968 | Chmielewski | 81/176.15 |
| 3,731,560 | 5/1973 | Bares | 81/90 |
| 3,903,762 | 9/1975 | Acrea | 81/90 |
| 4,227,429 | 10/1980 | Bowers | 81/90 |
| 4,748,875 | 6/1988 | Lang | 81/63 |
| 4,873,899 | 10/1989 | Mazurek | 81/63 |

*Primary Examiner*—D. S. Meislin

*Attorney, Agent, or Firm*—Sheldon H. Parker

[57] ABSTRACT

The cleat removal/install tool has a handle with a first end and a second end. A ratchet is positioned within said handle member proximate said first end. A cleat receiving tool is positioned within said ratchet member or is directly built as part of the ratchet member The cleat tool has a concave surface which functions to mate with the upper surface of the cleat. The concave surface should not be spaced from the surface of the ratchet. That is, the design must be such as to prevent twisting of the concave surface away from the cleat. The upper surface of the cleat removal tool is, in the preferred embodiment, one inch or less from the concave surface of the cleat removal tool. The low thickness of the tool, preferably on the order of about on three quarters of an inch, permits the user to apply pressure directly above and very close to the upper surface of the cleat. The spike receiving recess is provided in the curved surface so that the spike can nest in the tool during the removal or installation process. A pair of prong members extend from the concave surface of said cleat removal tool and serve to engage the cleat during the removal or installation. The prongs are dimensioned to enter corresponding recesses in the golf shoe cleats.

6 Claims, 11 Drawing Sheets

CLEAT REMOVAL/INSERTION TOOL

BACKGROUND OF THE INVENTION

1. Field of the Invention

The instant invention relates to a novel device for removing and installing cleats in athletic shoes, such as golf shoes. The instant device utilizes a ratchet system in which additional pressure can be added to easily remove or insert the cleats.

2. Brief Description of the Prior Art

The removal and replacement of golf shoe cleats has been a problem for many years. Many shoe cleat installation and removal tools have been of the type projecting straight from the cleat being worked, and manually pressed down thereon to maintain torque engagement with the cleat. Such tools typically have straight wrench projections of generally rectangular cross-section and have a tendency to become disengaged because there is no means for holding the wrench projections in the cleat wrench torque openings except for manual downward pressure. Means for aligning the wrench projections in the cleat wrench torque openings has also been lacking in such tools. With the downwardly maintained manual pressure required to engage these wrench projections all to often one receives barked knuckles and skinned hands upon accidental disengagement.

U.S. Pat. No. 3,903,762 to Acrea attempts to overcome some of the difficulties by disclosing a cleat removing tool with an angled tool for removal of the cleats. Due to the fact that the cleat protrudes through the removal tool, it is difficult to assert any additional pressure directly over the cleat and access holes. Additionally, the user's grip must be removed from the tool every quarter turn for regripping. U.S. Pat. No. 2,300,866 to Berstein also provides the angled tool but has the same leverage problems.

U.S. Pat. No. 2,461,639 to Grigalunas discloses a wrench which has a pair of prongs at its end to assist in the removal of the cleats. Although angled to allow for clearance of the cleats, there is again no provision for additional leverage and, if the prongs slip out of the cleat holes, it is easy for the user to hit his hand on the cleat ends. In U.S. Pat. No. 2,459,610 to Zadina removal and installation of cleats is through use of a two piece system which provides little clearance. Again, there is no leverage possible other than pressing down on the tool and no way to hold it in place to prevent twisting or accidental removal.

SUMMARY OF THE INVENTION

The shortcomings of the devices of the prior art are over come through the use of a novel cleat removal/installation tool. The tool has a handle with a first end and a second end. A ratchet is positioned within said handle member proximate said first end. It has a multisided gripping means, typically having six or twelve angled recesses. A cleat receiving tool is positioned within said ratchet member or is directly built as part of the ratchet member. The cleat tool has a concave surface which functions to mate with the upper surface of the cleat. The concave surface should not be space from the surface of the ratchet. That is, the design must be such as to prevent twisting of the concave surface away from the cleat. The upper surface of the cleat removal tool is preferably less than one inch from the concave surface of the cleat removal tool. The low thickness of the tool, preferably on the order of about on half of an inch, permits the user to apply pressure directly above and very close to the upper surface of the cleat.

The spike receiving recess is provided in the curved surface so that the spike can nest in the tool during the removal or installation process. A pair of prong members extend from the concave surface of said cleat removal tool and serve to engage the cleat during the removal or installation. The prongs are dimensioned to enter corresponding recess in the golf shoe cleats.

The ratchet containing end of the handle can be angularly off set from the body of the handle so as to accommodate the hand of the user.

The cleat removal member can be a two part unit where one portion threads in two the other portion. A lip is provided on each of the two parts. The lips extend along at least a portion of the periphery of the two parts so as to hold the two parts in a fixed engagement with the ratchet tool. An Allen head type of receiver can serve as means for tightening said first portion to said second portion.

The cleat removal tool is used by applying pressure to the upper surface of the tool and rotating the handle member while maintaining the pressure until said cleat is installed or removed.

DETAILED DESCRIPTION OF THE INVENTION

Figure 1:
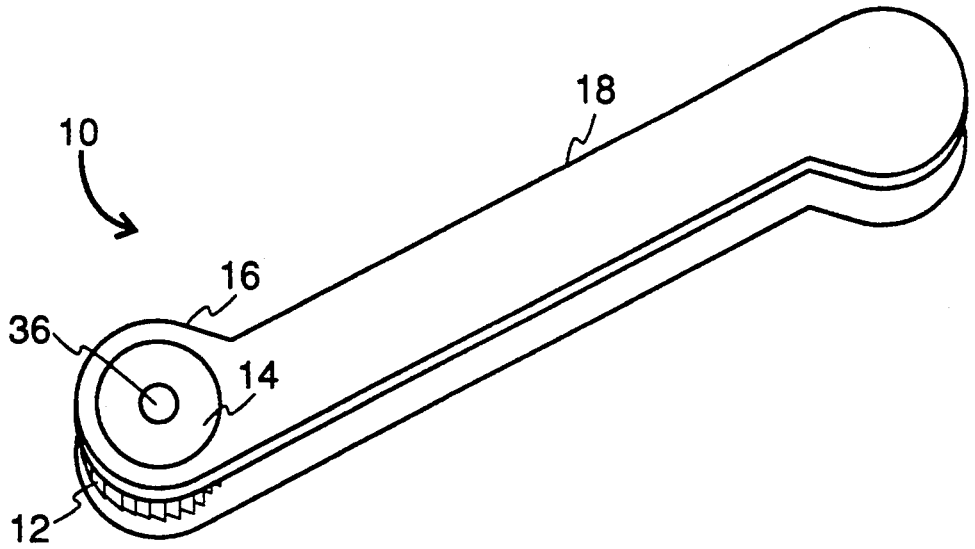
FIG. 1 is a perspective view of the cleat remover of the instant invention.

In the preferred embodiment, the cleat remover 10 of FIG. 1 is a ratcheting device containing a box end ratchet drive 12. The ratchet drive 12 is well known in the prior art with the standard clockwise, counterclockwise switch. The cleat removal disc 14 is manufactured as an integral part of the ratchet drive 12 and is provided with a hole 16. In the preferred embodiment, the handle 18 is offset with respect to the ratchet drive 12 to provide clearance over the cleats. The offset eliminates the necessity to reset the tool every quarter turn, thereby allowing a more rapid removal of the cleat. Using a prior art device, it can take ½ hour to 2 hours to change the cleats on a pair of shoes. Utilizing the instant device the time is reduced to approximately 10 minutes.

Figure 10:
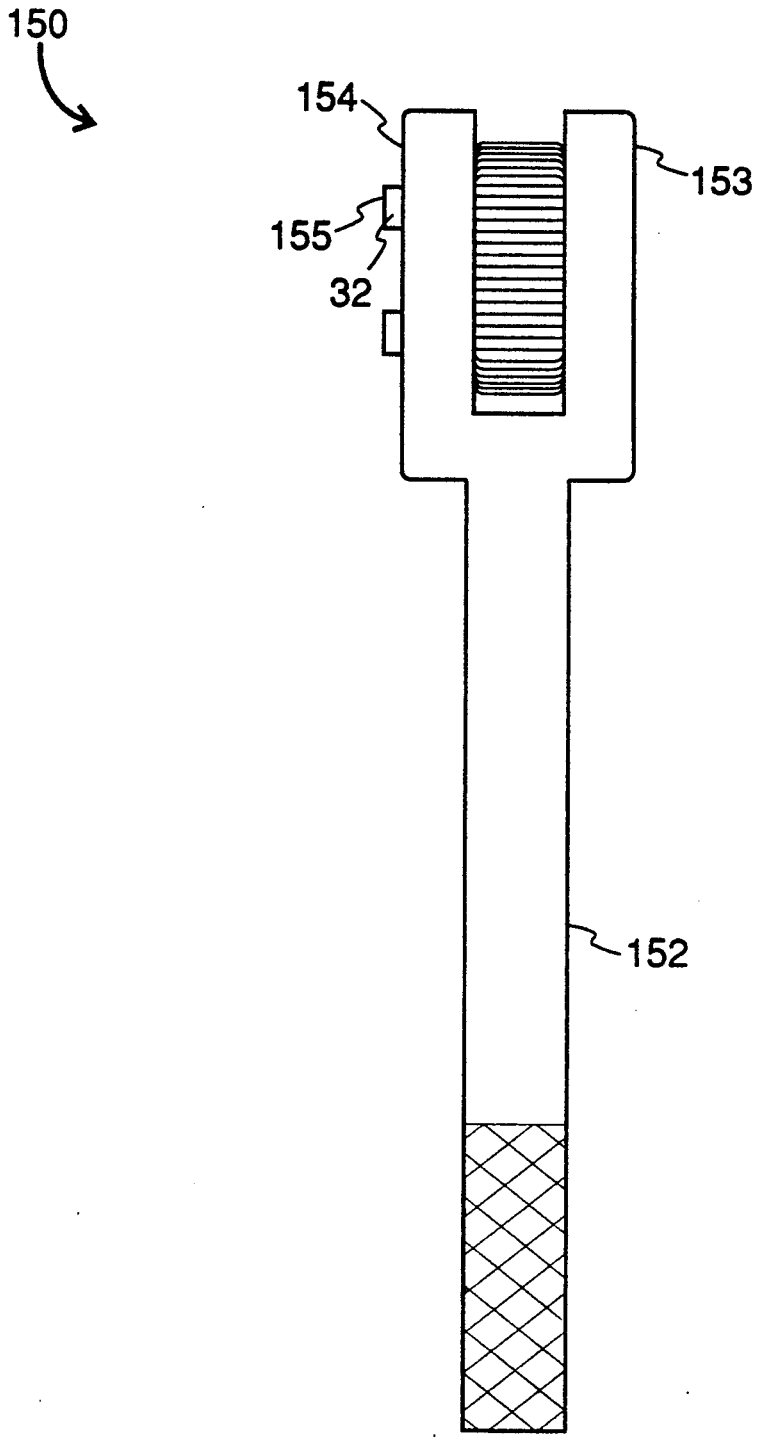

The use of a ratchet drive 12 provides the advantage that the user does not need to remove his hand from the tool to reposition for the next turn. By angling the handle 18 in relation to the ratchet drive 12, the rotation of the cleat for removal is simplified by allowing the user to rotate the handle 18 more than the standard quarter turn. If the alternate embodiment illustrated in FIG. 10 is utilized, the user can rotate the handle 152 of the straight handle ratchet 150 approximately one quarter turn. The advantage of the use of a ratchet drive still applies in that the user does not have to remove the tool and reinsert each turn. The ratchet tool can be of the design described in U.S. Pat. No. 4,748,875, the disclosure of which is incorporated by reference.

Figure 2:
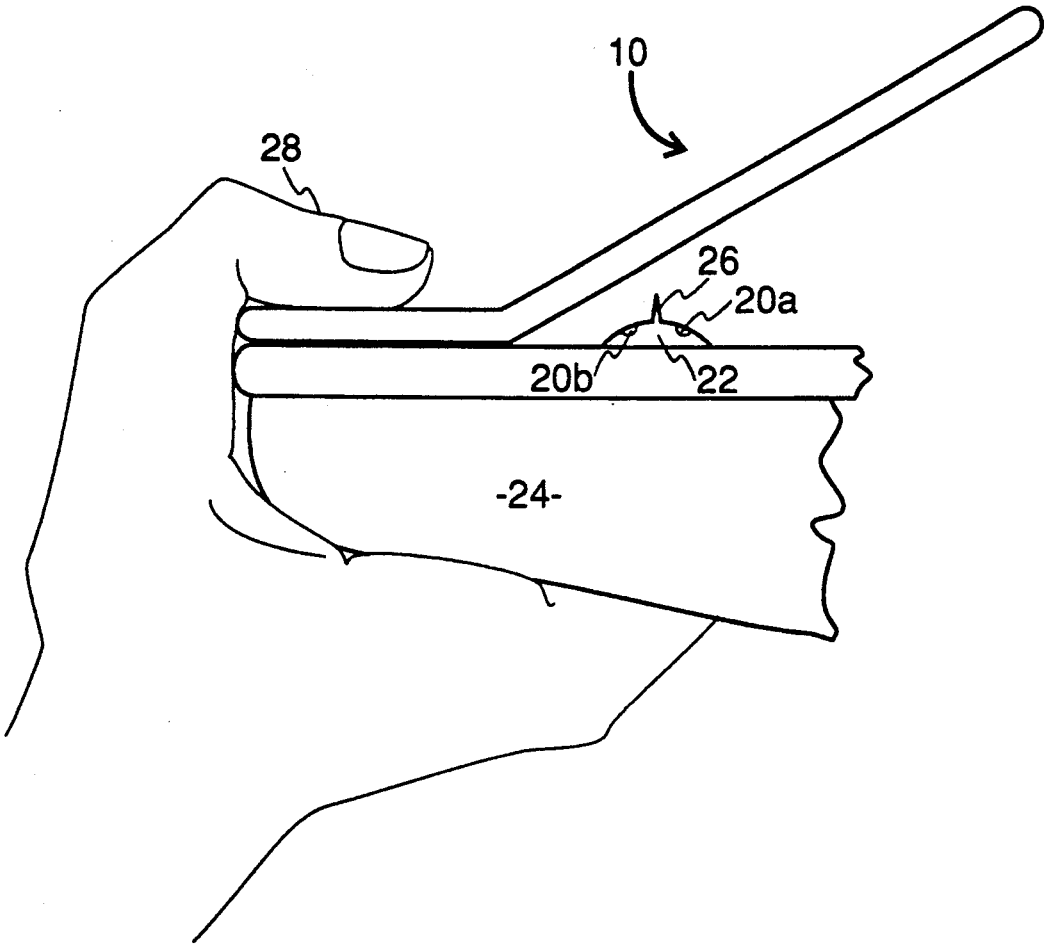
FIG. 2 is a side view of the cleat remover of FIG. 1 in contact with a shoe.

While dimensions are not narrowly critical, certain dimensions of the tool do contribute greatly to the advantages of the invention. As illustrated in FIG. 10, the ratchet end of the tool has an upper surface 153 and a lower surface 154. The closer the two surfaces the more effective is the action of the tool. As evident in FIG. 2, the use of a narrow tool permits the concave surface of the face 30 to mate with the corresponding surface of the cleat and to stay in place. The further the plane of the turning force is removed from the surface 30, the greater is the tipping or offsetting which can occur. It is this offsetting of the tool which causes the tool and the cleat to come apart during the removal or the inserting of the cleat. Thus, where the distance between the surface 153 and 154 is under one inch the chances of tool slipping off the cleat is diminished. Advantageously, the distance is no greater than about ¾ of an inch. As evidenced in FIG. 2, the dimension of the ratchet mechanism and the cleat removal tool is such that the thumb of the user is directly above the cleat and less than an inch above the cleat. Conversely, where the turning force is applied several inches above the cleat it is extremely difficult to maintain the cleat tool in contact with the cleat.

A problem which the prior art has not overcome is the ability to apply and direct added pressure. The prior art devices all utilize only the pressure which can be applied by the user pressing directly down on the device. The application of pressure from a distance can cause the removal tool to angle, either making removal difficult or stripping the threads on the cleat.

Figure 3:
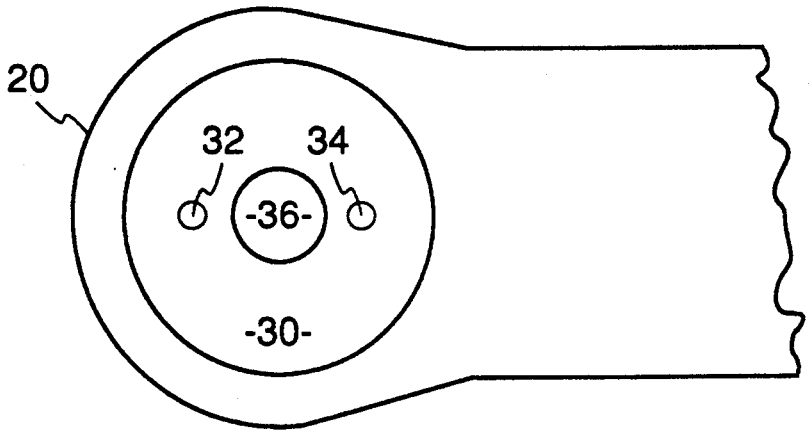
FIG. 3 is a front view of the face of the cleat remover.
Figure 4:
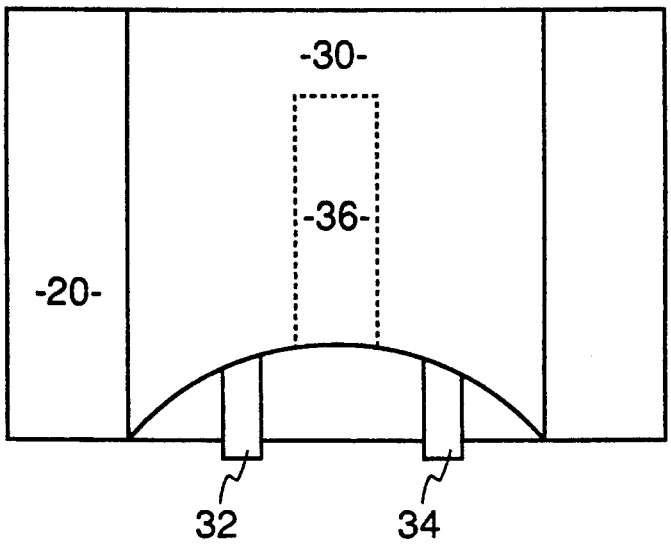
FIG. 4 is a cut away side view of the head of the cleat remover of FIG. 1.

The instant device overcomes this problem wherein the user's hand 28 can press down on the head 16 of the cleat remover 10 with either the thumb or palm of the hand and grip the shoe 24 with the hand. The use of a ratchet drive 12 allows the user to keep pressure on the head 16 of the cleat remover 10. The face 30 of the head 16, as illustrated in FIG. 3, is provided with a pair of prongs 32 and 34 which are spaced on the face to correspond with the removal holes 20 A and 20 B provided on the standard cleat. The prongs 32 and 34 must be manufactured to easily fit within the cleat removal holes 20A and 20B, however they cannot be so narrow as to allow excessive play and twisting or jeopardize their strength. The spike receiving opening 36 is centered in the face 30 of the head 16 and is dimensioned to receive the cleat spike 26 and allow the face 30 to lie flush with the cleat 22. The spike receiving opening 36 can either extend completely through the head 16 or can extend only partially through. The prongs 32 and 34 must be spaced a predetermined distance from the spike receiving opening 36 to allow for the prongs 32 and 34 to interact with the cleat holes 20 A and 20 B while the cleat spike 26 is positioned within the spike receiving opening 36. The face 30 of the head 20 is curved to correspond the convex contour of the cleat 22. The curving of the face 30 is described in more detail in FIG. 4.

Figure 5:
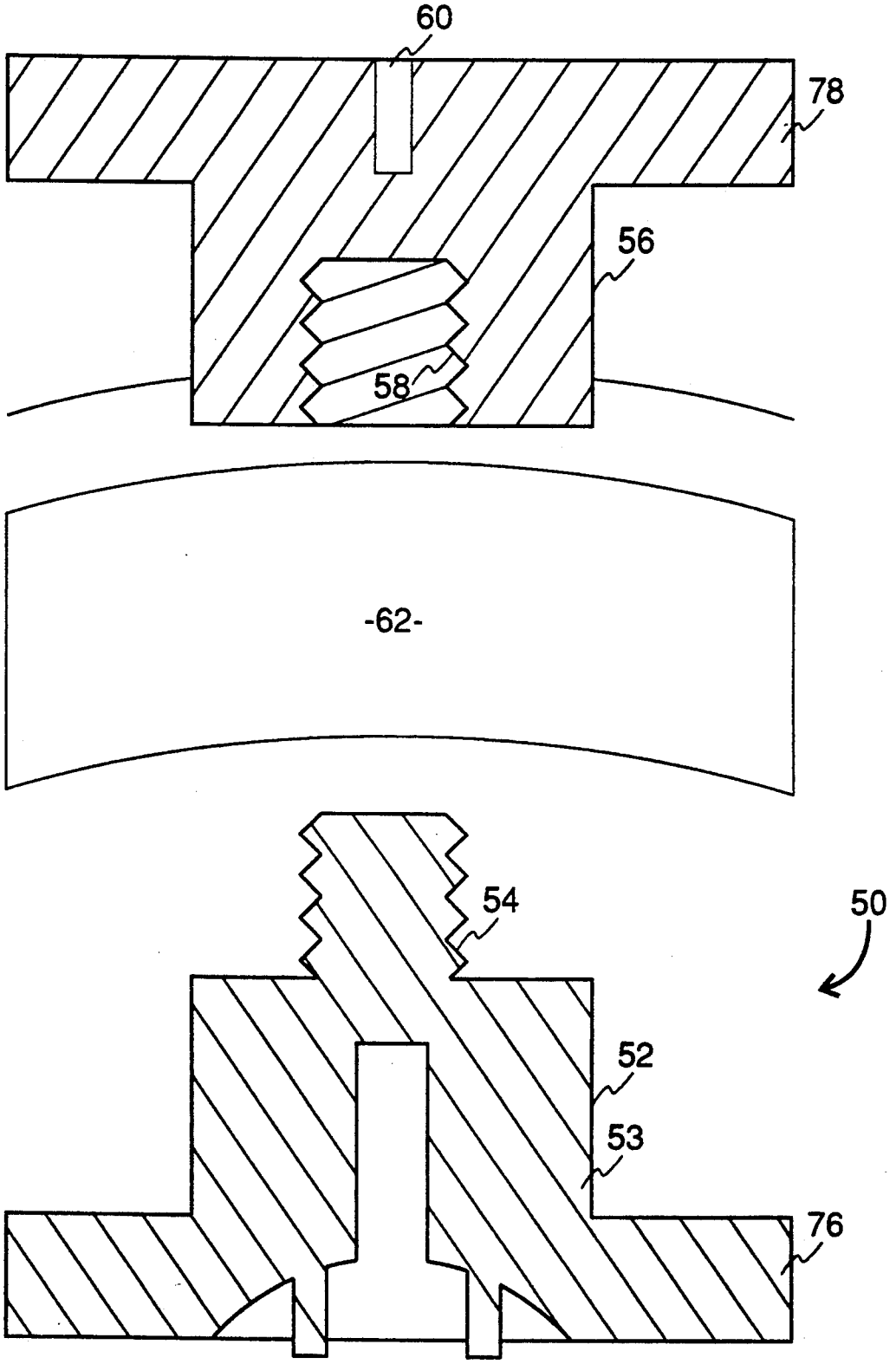
FIG. 5 is an exploded view of an alternate embodiment of the instant invention.

An alternate embodiment to the cleat remover is illustrated in FIG. 5 wherein the head 50 is an addable unit for retrofitting standard ratchets The head 50 consists of two sections, the male member 52 and the female member 56. The female member 56 has receiving grooves 58 which are in threadable connection with the locking grooves 54 of the male member 52. The rim 78 of the female member 56 prevents the female member 56 from slipping through the ratchet driver 62 during tightening. The body 53 of the male member 52 has a rim 76 which extends beyond the body and overlaps the ratchet driver 62. The rim 76, like rim 78, prevents the male member 52 from slipping through the ratchet driver 62 when tightened. Neither the rim 76 nor the rim 78 can have any substantial height or they will raise the height of the head 50 to a degree that it will interfere with the user applying direct pressure Excessive height in rim 76 will lift the head 50 too far from the surface of the shoe 72, shown in FIG. 6, to achieve maximum contact and minimum twisting. The female member 56 and the male member 52 are placed on either side of the ratchet drive 62 and screwed together with receiving grooves 58 and locking grooves 54.

Figure 6:
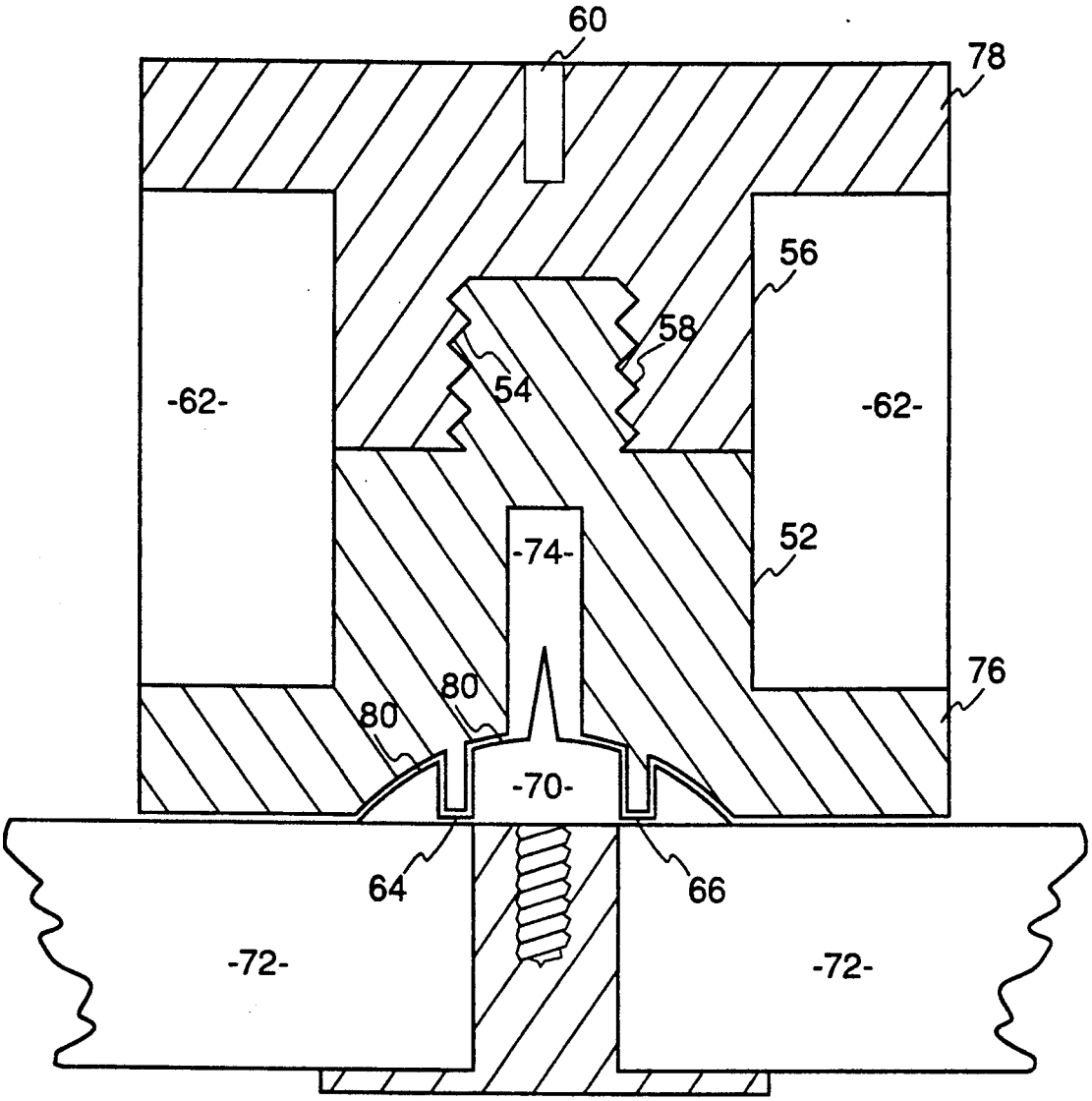
FIG. 6 is a cutaway view of the assembled embodiment of FIG. 4.
Figure 7:
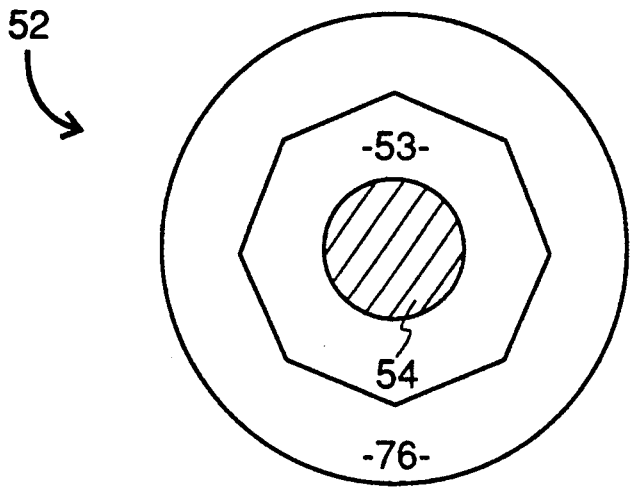
FIG. 7 is a top view of the male member of the embodiment of FIG. 5.
Figure 8:
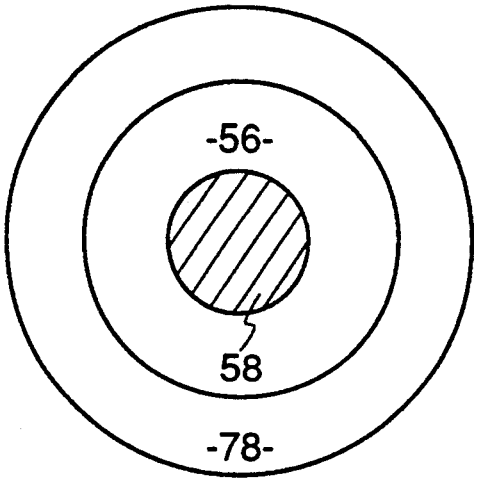
FIG. 8 is a bottom view of the female member of the embodiment of FIG. 5.

In FIGS. 5 and 6 the female member 56 has a groove 60 to receive an allen or hex wrench to facilitate the tightening of the male member 52 and female member 56. The use of the Allen or hex wrench to tighten the head 50 requires that the male member 52 lock within the ratchet driver 62 and the female member 56 turn freely. The male member 52 of FIGS. 5 and 6 is shown from a top view in FIG. 7. The body 53 is a hexagon shape to interlock with the ridges which are inherent to ratchet drivers. This interlocking action prevents the male member 52 from turning during the tightening or removal process. The locking grooves 54 must remain round, however the rim 76 can be either round or hexagon and is dependent on manufacture. A bottom view of the female member 56 is shown in FIG. 8 wherein all parts are round, allowing the female member 56 to turn freely within the ratchet driver 62. It should be noted that the shapes of the female/male members can be reversed and the use of the specified shapes herein should not limit the scope of the invention.

The assembled unit 50 is shown in FIG. 6 in contact with the cleat 70. The head 50 is locked into the ratchet drive 62 and has been placed so that the prongs 64 and 66 are inserted into the cleat holes and the cleat spike is inserted into the cleat receiving hole 74. The rims 76 and 78 are locked on either side of the ratchet driver 62, preventing movement of the head 50. The concave face 80 of the male member 52 must be manufactured to be in harmonization with the cleat 70. If the curvature of one surface is not the reciprocal of the other surface, the head 50 cannot fit snugly over the cleat 70 to gain the optimum leverage during removal and insertion. The curvature of the concave face 80 allows for flush or nearly flush contact with the shoe 72. This close contact with the shoe provides the balance and leverage required to easily remove the cleats 70.

Figure 9:
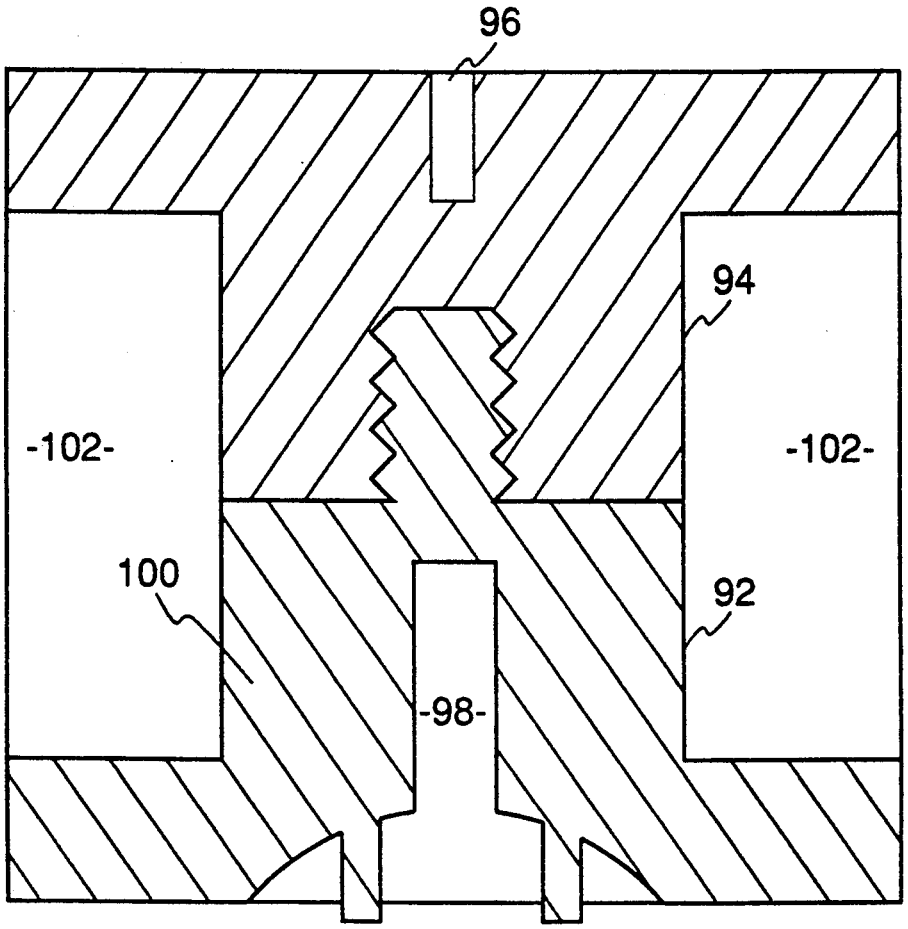
FIGS. 9-11 are an alternate embodiment of the instant invention.

An alternate embodiment to the retrofit cleat remover is illustrated in FIG. 9 wherein both the male member 92 and the female member 94 are provided with allen or hex wrench holes 96 and 98. The body 100 of the male member 92 is, in this embodiment, round and moves freely within the confines of the ratchet driver 102. The male member 92 and the female member 94 are placed on either side of the ratchet driver 102 and screwed together by hand to a desired degree. To tighten fully, an allen or hex wrench is placed in both the male member 92 and the female member 94 wrench receiving holes 96 and 98 and turned.

Figure 11:
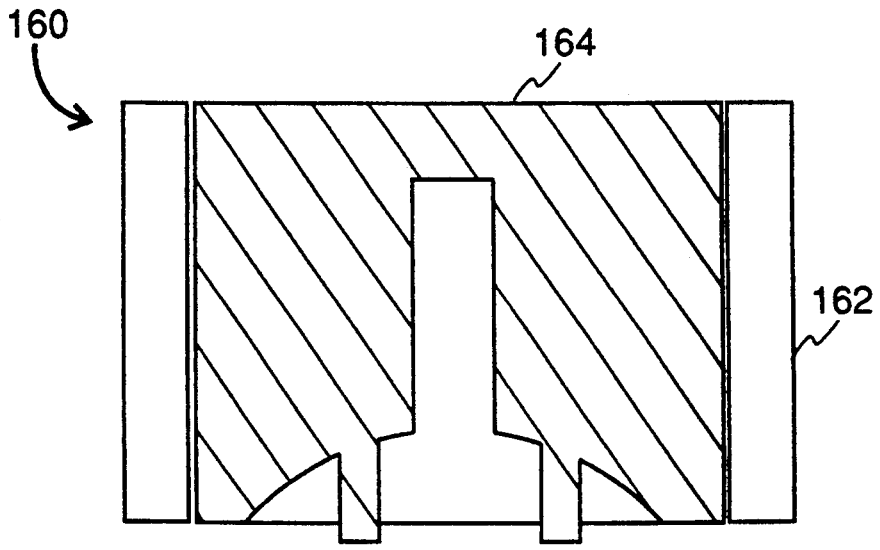

In FIG. 11 an alternate cleat removal device 164 is illustrated wherein the unit is manufactured in a single multisided piece, such as a hexagon or octagon. The cleat removal device 164 is dimensioned to fit within a standard box end ratchet drive 162. The cleat removal device 164 can be welded into the ratchet 162 for a permanent cleat removal tool 160. As an alternative, the cleat removal device 164 can be placed into the ratchet drive 162 during the removal process and then removed after use. This alternative provides the advantage of cost and space by eliminating the need for an additional tool. In the event the cleat removal device 164 is used with an independent, the dimensioning must be so that it has a friction fit with interior of the ratchet drive 162.

The preferred size of the cleat removing device is three quarter inch, however the size can vary as long as it meets the required dimensions between the prongs and the spike receiving opening. Any material, such as stainless steel, can be used for manufacture which can meet the strength criteria of the instant disclosure.

What is claimed is:

1. A cleat removal tool (10) having:

a handle member (18), said handle member having a first end and a second end, said first end having a ratchet member receiving region (16), said ratchet member receiving region having a first side and a second side;

a ratchet member (12), said ratchet member being positioned proximate said first end and within said ratchet receiving region, said ratchet member having a multisided gripping means;

a cleat removal member (50), said cleat removal member being positioned within said ratchet member and having a first side and a second side, said cleat member second side having a concave surface (30), said concave surface conforming to the contour of a golf shoe cleat, said second side concave surface having a spike receiving recess (36) for receiving a spike of a golf shoe cleat, said cleat removal member being a removable two piece member having a first portion and a second portion (52, 56), said first portion and said second portion having threaded mating means (54, 58), said first portion and said second portion being dimensioned to fit within said ratchet member (62) multisided gripping means;

a pair of prong members (32, 34), said pair of prong members extending from said concave side (30) of said cleat removal member, sad prongs being dimensioned to interact with the prong receiving recesses in golf shoe cleats.

2. The cleat removal tool of claim 1 wherein said handle member second end is angularly off set from said ratchet member.

3. A cleat removal tool (10) having:

a handle member (18), said handle member having a first end and a second end, said first end having a ratchet member receiving region (16), said ratchet member receiving region having a first side and a second side;

a ratchet member (12), said ratchet member being positioned proximate said first end, within said ratchet receiving region, said ratchet member having a multisided gripping means;

a cleat removal member (50), said cleat removal member being positioned within said ratchet member and having a first side (14) and a second side (30), said cleat member second side having a concave surface, said concave surface conforming to the contour of a golf shoe cleat, said second side concave surface having a spike receiving recess for receiving a spike of a golf shoe cleat, said cleat removal member being a removable two piece member having a first portion and a second portion, said first portion and said second portion having threaded mating means (54, 58), said cleat removal member being dimensioned to fit within said ratchet member multisided gripping means, each of said first portion and said second portion having a lip member, each of said first portion lip member (78) and said second portion lip member (72) being on opposite sides of said ratchet member (62), whereby said cleat removal member is secured to said ratchet member;

a pair of prong members (32, 34), said pair of prong members extending from said concave side (30) of said cleat removal member, said prongs being dimensioned to interact with the prong receiving recesses in golf shoe cleats.

4. A golf cleat removal wrench (10) having:

a handle member (18), said handle member having a first end (18) and a second end, said first end having a ratchet member receiving region, said ratchet member receiving region (16) having a first plate and a second plate;

a ratchet member, said ratchet member having peripheral teeth for engagement with pawl means for locking said ratchet member against rotation in one of clockwise or counter-clockwise direction, said ratchet member being positioned between said ratchet member receiving region first plate and second plate;

a cleat removal member, said cleat removal member being within and fixed to said ratchet member between said first plate and said second plate, such that said first plate and said second plate retain said cleat removal member within said wrench, said cleat member having a concave side, said concave side being contoured to correspond to the shape of a golf shoe cleat convex surface, said concave surface having a spike receiving recess for receiving the spike of a golf shoe cleat, said cleat removal member having a pressure receiving side opposite said concave side, said pressure receiving side having a finger receiving region contoured to accommodate a finger;

a pair of prong members, said pair of prong members extending from said concave side of said cleat removal member, and being dimensioned to interact with the prong receiving recesses in golf shoe cleats, whereby pressure is applied directly to said pressure receiving region for maintaining said cleat removal member is firm contact with a golf shoe cleat, 5. The device of claim 4, wherein said cleat removal member is fixed to said ratchet member by being integral with said ratchet member.

6. A cleat removal tool having:

handle member said handle member having a first end and a second end;

a ratchet member, said ratchet member being positioned within said handle member proximate said first end and having a multisided gripping means;

a cleat removal member, said cleat removal member being positioned within said ratchet member and having a first side and a second side, said second side having a concave surface, a spike receiving recess in said concave surface;

a pair of prong members, said pair of prong members extending from said concave surface of said cleat removal member, said handle member first end having a first surface and a second surface, said first surface being less than one inch from said second surface and said cleat removal member being positioned within said ratchet member and having its concave surface lying in a plane which is proximate said first surface of said first end such that the peripheral portion of said concave surface is less than one inch from said second surface of said first end.

* * * * *